United States Patent [19]

Karaba et al.

[11] 4,241,705

[45] Dec. 30, 1980

[54] VARIABLE COMPRESSION RATIO PISTON

[75] Inventors: Albert M. Karaba; Brian C. Kauffman; Glen L. Bowen, all of Muskegon, Mich.

[73] Assignee: Teledyne Industries, Inc., Los Angeles, Calif.

[21] Appl. No.: 928,363

[22] Filed: Jul. 27, 1978

[51] Int. Cl.[3] ..... F02B 75/04

[52] U.S. Cl. ..... 123/78 B; 92/82; 123/48 B

[58] Field of Search ..... 123/47 R, 48 B, 78 B, 123/193 P; 137/493.9; 92/80, 82

[56] References Cited

U.S. PATENT DOCUMENTS

| | | | |
|---|---|---|---|
| 2,698,054 | 12/1954 | Brown et al. | 137/493.9 X |
| 2,742,027 | 4/1956 | Mansfield | 92/82 |
| 3,304,952 | 2/1967 | Krone | 137/493.9 |
| 3,405,697 | 10/1968 | Marchand | 123/48 B |
| 4,016,841 | 4/1977 | Karaba et al. | 123/78 B |
| 4,031,868 | 6/1977 | Karaba et al. | 123/48 B |

FOREIGN PATENT DOCUMENTS

| | | | |
|---|---|---|---|
| 590712 | 7/1947 | United Kingdom | 137/493.9 |

*Primary Examiner*—Irwin C. Cohen

*Attorney, Agent, or Firm*—Gifford, VanOphem, Sheridan & Sprinkle

[57] ABSTRACT

A two part variable compression ratio (VCR) piston assembly having an outer member movable relative to an inner member to vary the compression ratio of an internal combustion engine and a hydraulic system utilizing oil from the lubrication system of the engine for automatically controlling the relative movement of the members to maintain a predetermined maximum combustion chamber pressure. A hydraulic circuit includes an upper and lower chamber which expand and contract conversely upon relative movement of the piston members and a system for supplying oil to the upper chamber and to the lower chamber via the upper chamber and for discharging the oil from the upper chamber in a manner which gradually changes the compression ratio of the piston until a predetermined maximum combustion chamber pressure has been achieved and which tends to maintain the maximum combustion chamber pressure after it has been achieved. A valve assembly for supplying lubricant to the upper chamber and for discharging lubricant from the upper chamber into the engine crankcase upon a predetermined maximum pressure includes a housing which is insertable into a bore formed on the piston inner member and detachably locked into position.

11 Claims, 3 Drawing Figures

Fig-2
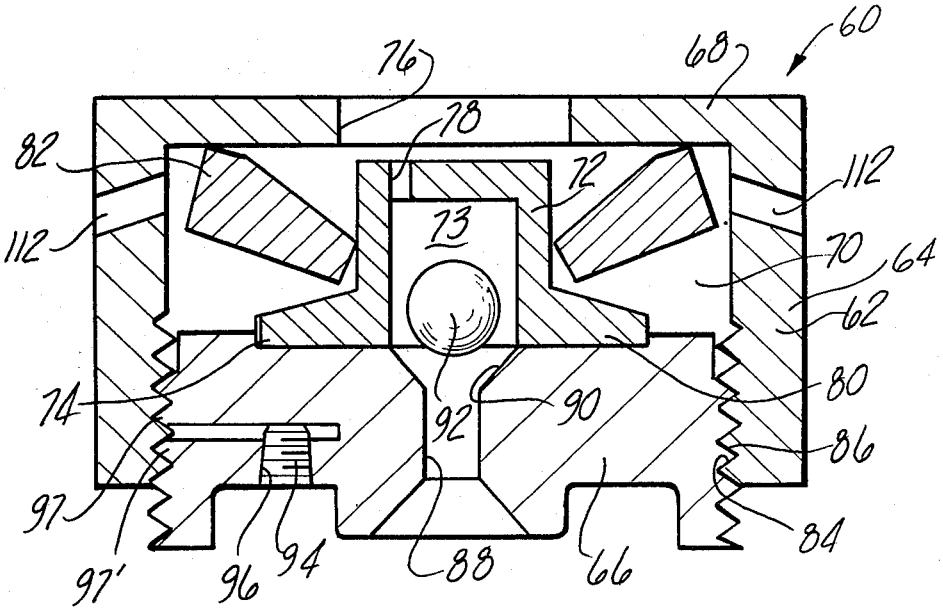
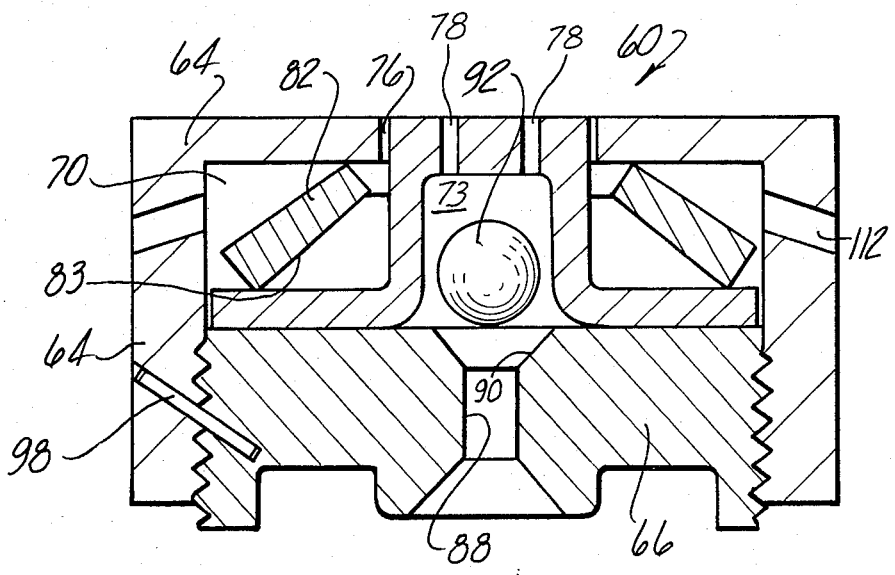
Fig-3

VARIABLE COMPRESSION RATIO PISTON

BACKGROUND OF THE INVENTION

I. Field of the Invention

The present invention relates to a variable compression ratio (VCR) piston assembly, such as those disclosed in U.S. Pat. Nos. 3,156,162; 3,161,112; 3,185,137; 3,185,138; 3,303,831; 3,311,096; 3,403,662; 3,418,982; 3,450,111; 3,417,738; 3,417,739; 3,450,112; 3,527,264; 3,405,698; 3,405,697; 3,450,113; 3,407,791; 3,667,433; 3,704,695; 4,016,841 and 4,031,868; all owned by applicants' assignee and more particularly to an improved construction for such piston assemblies.

II. Description of the Prior Art

In the constructions disclosed in the patents indicated above an inner piston member is connected in the usual manner to a connecting rod while an outer piston member is carried by and is movable axially relative to the inner member. Relative movement of these members varies the compression ratio of the particular cylinder in which the piston moves. Clearance spaces are provided between the top and bottom ends of the inner and outer members, respectively, and these form upper and lower chambers which vary conversely in volume in relation to the relative movement of the piston members. An essentially incompressible fluid, such as the engine lubrication oil, is supplied to these chambers in a manner which automatically regulates movement of the members to gradually change the compression ratio until a predetermined combustion pressure has been achieved. The hydraulic system then varies the movement of the members in a manner which tends to maintain a uniform maximum combustion chamber pressure.

Conventionally, the hydraulic system for these previously known VCR piston assemblies include both a supply passage and a discharge passage through the piston inner member both of which are connected to the upper fluid chamber. A one-way check valve in the supply passage permits only fluid flow from the supply passage and into the upper chamber while, conversely, a normally closed valve in the discharge passage opens at a predetermined pressure in the upper fluid chamber and permits fluid to discharge through the discharge passage and into the engine crankcase.

In these previously known VCR piston assemblies, it has been the conventional practice to mount and entrap both the supply inlet valve and the normally closed discharge valve between a plate and the top end of the inner piston member. The plate in turn is secured to the inner piston member by bolts or similar fastening means.

These previously known VCR piston assemblies are thus disadvantageous in that virtually total disassembly of the VCR piston assembly is required in order to obtain access to either the inlet or discharge valve assemblies. Such access is required, for example, for inspection, maintenance and/or repair of these valve assemblies.

A further disadvantage of these previously known VCR piston assemblies is that the discharge valve, typically a Bellville washer, is tensioned or prestressed against the mounting plate secured to the upper end of the inner piston member. Since the mounting plate is directly secured to the upper end of the piston inner member, individual adjustment of the tension on the discharge valve was impossible. Rather, variation of the tension of the discharge valve has heretofore required shimming of the discharge valve height.

SUMMARY OF THE PRESENT INVENTION

The present invention overcomes these above mentioned disadvantages of the previously known VCR piston assemblies by providing such a piston assembly in which both the inlet and discharge valves are relatively easily accessible and also in which the tension upon the discharge valve is easily and infinitely adjustable.

In brief, the VCR piston assembly according to the present invention comprises an inner piston and an outer piston member telescopically mounted onto the upper end of the inner piston member. As in the previously known VCR assemblies, an upper hydraulic chamber is formed between the upper end of the inner member and the inner end of the outer member while a lower chamber is fluidly connected to the upper chamber and disposed adjacent the piston ring area of the piston assembly. Both a lubricant supply passage and a discharge passage are formed through the piston inner member and are fluidly connected with the upper chamber.

Unlike the previously known VCR piston assemblies, however, both the supply inlet valve and the discharge valve are contained within a single housing and, together with the housing, form a valve assembly. The valve assembly in turn is slidably received within a bore formed in the upper end of the piston inner member and locked into position by a snap ring or other appropriate means. This construction thus allows elimination of the previously used mounting plate for entrapping the inlet and discharge valves in the piston inner member.

In the preferred form of the invention, the valve assembly housing includes a first and second part. The first housing part is cylindrical and tubular in shape, substantially closed at one end and defines a generally cylindrical chamber in which both the supply and discharge valves are positioned and so that the discharge valve abuts against the closed end of the first housing part. The second housing part functions as a form of a plug which is screwed into the other end of the first housing part thus entrapping the supply and discharge valves between the housing parts. Moreover, the tension on the discharge valve can be easily and infinitely varied by adjusting the axial and/or rotational position of the second housing part relative to the first housing part.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 2 is a longitudinal sectional view of the valve assembly of the present invention and enlarged for clarity; and FIG. 3 is a longitudinal cross-sectional view similar to FIG. 2 but showing a modification of a valve assembly for a VCR piston assembly according to the present invention.

DETAILED DESCRIPTION OF THE PRESENT INVENTION

Figure 1:
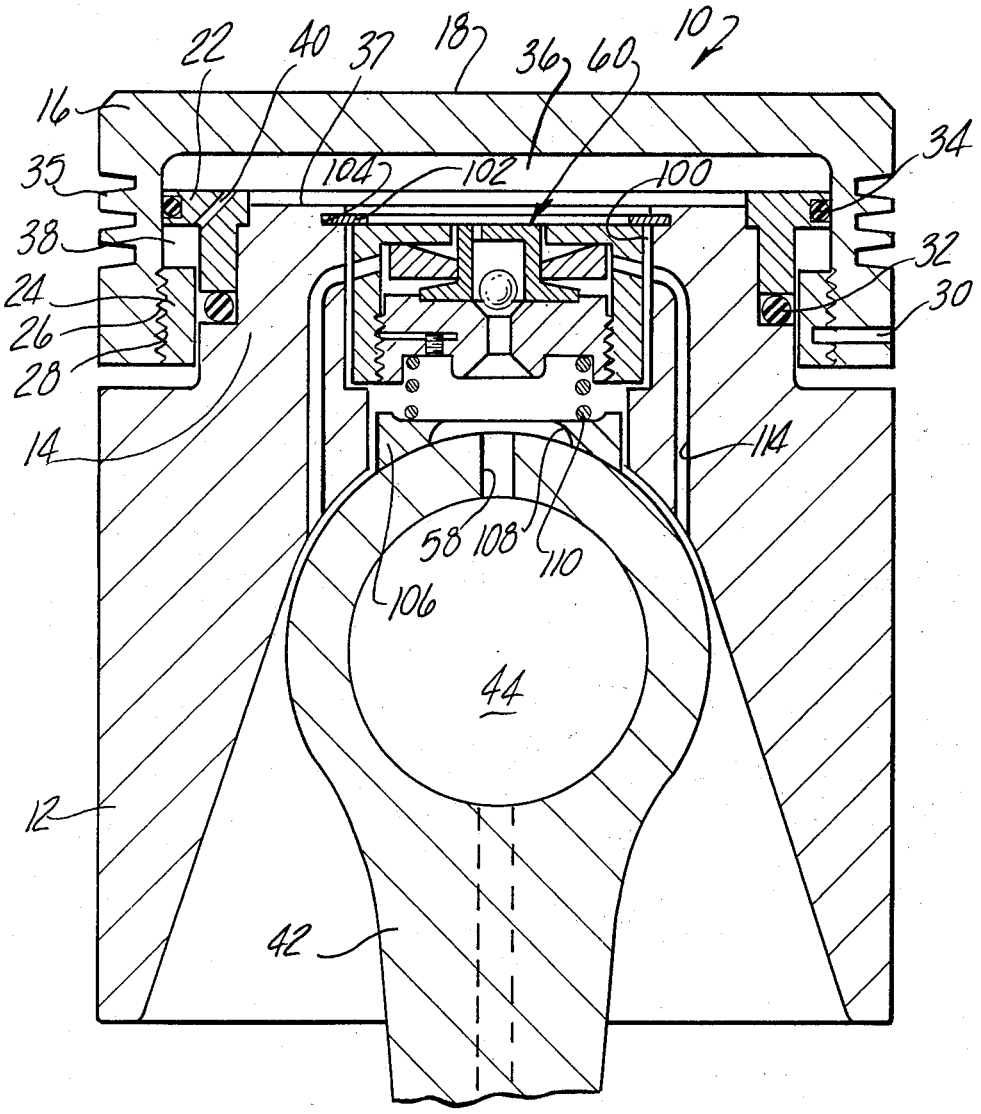
FIG. 1 is a longitudinal cross-sectional of a VCR piston assembly employing a preferred construction of the present invention and showing the valve assembly in one adjusted position.

With reference to FIG. 1, a preferred variable compression ratio (VCR) piston assembly 10 according to the present invention is thereshown and comprises an inner member 12 having a radially reduced upper portion 14. An outer piston member 16 is mounted to the outer surface of the inner member reduced portion 14.

The outer member 16 has a crown 18 which serves as the head of the piston assembly 10 and which is compatible with the selected combustion system. The crown 18 forms a movable wall of the lower boundary of the combustion chamber of the engine (not shown) and is axially slidably or telescopically mounted to the outer surface of the reduced portion 14 of the inner piston member 12.

An annular retaining ring 22 is mounted to the top of the inner member 12 by appropriate means (not shown) and around the periphery of the reduced portion 14 of the inner member 12. A ring 24 having external threads 26 is positioned around the reduced diameter portion 14 of the inner member 12 and threadably engages internal threads 28 formed on the inside surface of the lower portion of the piston outer member, it being understood that other means of attachment between the ring 24 and outer member 16 can also be employed. A lock and travel limiting means, such as a lock pin 30 prevents rotation of the ring 24 relative to the piston outer member 16 and, therefore, axial travel of the ring 24 relative to the outer member 16. Appropriate seals 32 and 34 are provided between the inner member 12 and the outer member 16 of the piston assembly 10 to provide a fluid seal between the piston members in the area of their sliding contact.

An upper chamber 36 is formed between the upper end 37 of the piston inner member and the inside surface of the piston outer member 16 while a lower annular chamber 38 is formed between the annular member 22, the outer piston member 16 and the upper end of the ring 24 adjacent to the ring groove area 35 of the piston assembly 10. The seals 32 and 34 prevent oil leakage from the lower chamber 28 except through a passage 40 which is formed through the annular member 22 and connects the upper chamber 36 to the lower chamber 38. The passage 40 provides fluid transfer between the upper chamber 36 and the lower chamber 38.

The inner piston member 12 is connected to a connecting rod 42 by a piston pin 44 in the conventional manner of connecting an engine piston to a connecting rod. A passage 58 in the connecting rod 42 communicates with the lubrication system of the engine by means not shown.

A unique valve assembly 60, best shown in FIGS. 2 and 3, is provided for regulating the fluid flow into and out from the upper chamber 36 of the piston assembly 10. The valve assembly 60 comprises a housing 62 having a first part 64 and a second part 66. The first housing part 64 is generally tubular and cylindrical in shape and has a radial wall portion 68 at its upper end with a central aperture 76. The housing first part 64 defines a generally cylindrical interior chamber 70.

A tubular one-way valve body 72 for a one-way check valve ball 92 is positioned within the cylindrical chamber 70 so that its upper end registers with the central aperture 76 and includes a fluid passage 78 formed therethrough. The clearance between the aperture 76 and body 72 provides a filter as is well known in the art. A radially outwardly extending flange 80 at its other end of the one-way valve body 72 provides a support for a tapered washer or a Bellville spring type valve 82 which is mounted over the one-way valve body 72 as shown in FIG. 2. The other end of the washer 82 abuts against the radial wall portion 68 of the housing first part 64.

The second valve assembly housing part 66 is disc shaped and includes external threads 84 about its outer periphery which cooperate with internal threads 86 formed about the open lower end of the housing first part 64. Upon screwing the housing second part 66 into the housing first part 64, both the tubular one-way valve body 72 and the spring washer 82 are entrapped between the housing parts 64 and 66 and within the chamber 70. An axial fluid passageway 88 through the housing second part 66 establishes fluid communication from the fluid passageway 58 to the interior 73 of the tubular one-way valve body 72. The upper end of the passageway 88 is conically shaped and forms a valve seat 90 for a check valve ball 92 positioned within the interior 73 of the body 72.

The axial position of the housing second part 66 relative to the first part 64, i.e. the amount that the housing second part 66 is screwed or rotated into the first part 64, establishes the preload or tension upon the spring washer 82. For example, the housing second part 66 is screwed into the housing first part 64 to a much greater extent in FIG. 1 than in FIG. 2 so that the preload on the spring washer 82 is much greater in FIG. 1 than in FIG. 2 and is exaggerated for clarity. The amount of tension on the spring washer 82 in turn determines the pressure at which the spring washer 82 snaps open as will become hereinafter apparent.

Any appropriate means can be employed to prevent rotation of the valve housing second part 66 relative to the first part 64 once the housing parts are secured together at the desired position. For example, in the preferred form of the invention, an Allen set screw 94 threadably engages an axial threaded bore 96 in on the bottom of the housing second part 66 and closely adjacent the threads 84. The bore 96, however, is smaller than the screw 94 such that as the screw 94 is screwed into the bore 96, it spreads apart the threads 97 and 97' of the housing second part 66 which simply, but effectively, prevents further rotation of the housing parts 64 and 66 relative to each other. Other means, such as a radially extending pin 98 (FIG. 3) extending between the housing parts 64 and 66 can also be used to prevent rotation of the housing parts 64 and 66 relative to each other.

Referring to FIG. 1, with the housing parts 64 and 66 properly set and locked against rotation relative to each other, the entire valve assembly 60 is then positioned in a cylindrical bore 100 formed axially in the upper end of the piston inner member 12 and substantially directly above the connecting rod 42. A snap ring 102 engages an annular groove 104 formed about the upper end of the bore 100 and extends across the valve assembly 60 to detachably lock the valve assembly within the bore 100. At the opposite end of the valve assembly 60, a slipper 106 with a central opening 108 is urged against the upper end of the connecting rod 42 by a spring 110 disposed between the slipper 106 and the bottom of the housing second part 66. The valve assembly is axially restrained by the snap ring 102.

The one-way valve 92 in the valve assembly 60 establishes fluid communication between the supply passage 58, through the passageway 88 and into the upper chamber 36 via the passageway 78. Conversely, a discharge passageway is established from the upper chamber 36 through the aperture 76 through the housing radial wall portion 68 and around the tubular body 72. With the spring washer or discharge valve 82 open, i.e. in its downward position, fluid can flow through radial openings 112 formed through the housing first part 64 and to discharge passageways 114 in the piston member 12. The passageways 114 are open at their lower end to the crankcase of the engine.

As the invention has thus far been described, it is apparent that the inner member 12 being connected to the connecting rod 42 in the conventional manner moves up and down within the cylinder of an internal combustion engine within fixed limits and in the manner of a conventional piston. The outer member 16 reciprocates with the piston within the axial limits defined at the lower limit by the crown 18 engaging the top of the inner member 12 and at its upper limit by the top of the ring 24 engaging the lower edge of the radially protruding portion of the annular member 22. Thus, as the piston reciprocates, the outer member 16 will then move under the influence of inertia toward the extreme uppermost position where as the oil volume is lost from the upper chamber 36 to the crankcase through the discharge valve 82 results in movement of the outer member 16 to its lowermost positions. The lubricant supplied to the chambers 36 and 38, however, regulates this movement in a manner to provide an increased compression ratio for the engine while at the same time maintaining a predetermined maximum combustion chamber pressure which is established by the opening pressure setting of the discharge valve 82.

The inertia and oil pressure acts upon the outer member 16 at the upper end of the exhaust stroke and in the early part of the downward intake stroke thus causing the outer member 16 to separate from the inner member 12. As the members separate and the upper chamber 36 expands, the ball 92, which acts as a one-way inlet valve, moves to a position to permit oil to be directed into the expanding upper chamber 36 from the passages 58 and 88. The ball 92 prevents the oil from passing back into the supply valve from the upper chamber 36 during the downward strokes of the piston.

Preferably the upper chamber is connected directly to the lower chamber 38 by the passage 40. The passage 40, however, is preferably restricted and limits the rate of flow between the chambers 36 and 38 to limit excessive piston travel per stroke.

As more fully described in U.S. Pat. Nos. 4,016,801 and 4,031,868, the tapered spring or discharge valve 82 utilized in the present invention provides fast dumping of lubricant from the upper chamber 36 to the crankcase of the engine upon the attainment of the predetermined maximum pressure in the upper chamber 36. As has been previously described, the opening pressure setting of the discharge valve 82 can be infinitely variably preset by adjusting the rotation or inward travel of the second housing part 66 relative to the first housing part 64.

A modification of the valve assembly 60 for the VCR piston assembly 10 of the present invention is shown in FIG. 3 and differs from that shown in FIGS. 1 and 2 in that the tapered washer or Bellville spring 82 is inverted within the housing chamber 70. As such, the upper chamber 36 of the piston assembly 10 communicates via the aperture 76 with the inner face 83 of the tapered washer 82. Thus, upon the attainment of the predetermined pressure necessary to open the discharge valve 82, the discharge valve 82 snaps upwardly and establishes fluid communication from the aperture 76, through the radial ports 112 and to the crankcase of the engine.

From the foregoing it can be seen that the encapsulated valve assembly 60 according to the present invention provides several advantages unknown to the previously known VCR piston assemblies. In particular, the entire valve assembly 60 can be easily, simply and rapidly removed from or installed in the VCR piston assembly 10 when required for maintenance, repair or replacement. Moreover, the opening pressure setting of the discharge valve 82 can be easily and infinitely variably preset by simply rotating the housing parts 64 and 66 relative to each other and in a manner which has been heretofore unknown without disasembly of the piston.

Having described our invention, however, many modifications thereto will become apparent to those skilled in the art to which it pertains without deviation from the spirit of the invention as defined by the scope of the appended claims.

We claim:

1. In an internal combustion engine, a piston having an inner member and an outer member telescopically received by said inner member, said members being movable in response to reciprocation of the piston with respect to a combustion chamber of the engine, said members forming a fluid chamber therebetween, said fluid chamber varying in volume in response to said relative movement and to variations in the quantity of fluid therein, and means for supplying fluid to said chamber, said means comprising a supply passage in said piston connecting with said fluid chamber, and a discharge passage connected with said fluid chamber and with the crankcase of said engine, the improvement which comprises:

a bore formed in said piston inner member open at one end to said fluid chamber and formed with a stop surface at its other end;

a valve assembly, said valve assembly having a housing wholly inserted into said bore in the piston inner member adjacent to said stop surface whereby said assembly is removable and accessible solely from said one end of said bore by removal of said outer member;

a one way inlet valve contained in said housing and in said supply passage;

a normally closed valve contained within said housing and in said discharge passage, said normally closed valve being operable upon a predetermined pressure in said fluid chamber to open and thereby permit fluid to discharge from said fluid chamber and into the crankcase; and means for detachably locking said valve assembly housing in said piston inner member bore, wherein said detachable locking means comprises a retainer means removably mounted in said piston inner member bore about the top thereof, said retainer means including a portion which extends over said valve assembly housing to retain said valve assembly housing within said piston inner member bore.

2. The invention as defined in claim 1 wherein said valve assembly housing comprises a first housing part and a second housing part, means for detachably connecting said housing parts together whereby said housing parts define an interior housing chamber therebetween and wherein said one-way inlet valve and said normally closed valve are contained within said housing chamber.

3. The invention as defined in claim 2 wherein said housing first part is tubular and cylindrical in shape and includes a radial inwardly extending wall portion at one end and wherein said housing second part is substantially disc-shaped and axially detachably connected to the housing first part at its other end.

4. The invention as defined in claim 3 wherein said means for detachably connecting said housing parts together comprises cooperating threads between said housing first part and said housing second part whereby the axial length of the housing interior chamber is dependent upon the rotational position of said housing second part with respect to said housing first part.

5. The invention as defined in claim 2 wherein said normally closed valve comprises a tapered spring washer having its outer most edge sealingly engaging the radially inwardly extending wall portion of the first housing part, and wherein said improvement further comprises means for varying the axial length of said interior housing chamber to thereby vary the preload tension on said spring washer.

6. The invention as defined in claim 5 wherein said last mentioned means comprises an axial threaded engagement between said housing first part and said housing second part whereby rotation of one housing part relative to the other varies the axial length of the interior housing chamber.

7. The invention as defined in claim 6 wherein said one-way inlet valve includes a tubular cylindrical housing with a radially outwardly extending flange at its lower end, said spring washer being positioned over said inlet valve housing and supported by the upper side of said radial flange, the lower side of said radial flange being in abutment with and supported by said housing second part.

8. The invention as defined in claim 4 and including means for locking said housing parts together at a preset rotational position with respect to each other.

9. The invention as defined in claim 8 wherein said last mentioned means comprises a threaded bore formed substantially parallel to and closely adjacent the threaded connection between said housing parts in one of said housing parts and a threaded member for threadably engaging and spreading said last mentioned threaded bore, said threaded member being greater in diameter than said threaded bore.

10. The invention as defined in claim 1 wherein said normally closed valve comprises an annular spring washer having its inner edge in sealing abutment with the radially inwardly extending wall portion of the housing first part and having its outer edge in sealing abutment with an outwardly extending flange on the one-way inlet valve.

11. In an internal combustion engine, a piston having an inner member and an outer member telescopically received by said inner member, said members being movable in response to reciprocation of the piston with respect to each other and with respect to a combustion chamber of the engine, said members forming a fluid chamber therebetween, said fluid chamber varying in volume in response to said relative movement and to variations in the quantity of fluid therein, and means for supplying fluid to said chamber, said means comprising a supply passage in said piston connecting with said fluid chamber, and a discharge passage connected with said fluid chamber and with the crankcase of said engine, the improvement comprising:

a bore formed in said piston inner member open at one end to said fluid chamber and formed with a stop surface at its other end;

a valve assembly, said valve assembly having a housing inserted into said bore in the piston inner member adjacent to said stop surface whereby said assembly is removable and accessible solely from said one end of said bore by removal of said outer member;

a one way inlet valve contained in said housing and in said supply passage;

a normally closed valve contained within said housing and in said discharge passage, said normally closed valve being operable upon a predetermined pressure in said fluid chamber to open and thereby permit fluid to discharge from said fluid chamber and into the crankcase; and means for detachably locking said valve assembly housing in said piston inner member bore, wherein said detachable locking means comprises a retainer means removably mounted in said piston inner member bore about the top thereof, said retainer means including a portion which extends over said valve assembly housing to retain said valve assembly housing within said piston inner member bore;

wherein said valve assembly housing comprises a tubular, cylindrical first housing part, having a radially inwardly extending wall portion at one end axially detachably connected to a substantially disc-shaped second housing part, said housing parts defining an interior housing chamber therebetween, said one-way inlet valve and said normally closed valve being within said housing chamber, wherein said normally closed valve comprises a tapered spring washer having an edge thereof sealingly engaging the radially inwardly extending wall portion of said first housing part, and wherein said improvement further comprises means for varying the axial length of said interior housing chamber to thereby vary the preload tension on said spring washer.

* * * * *